United States Patent [19]

Wilmes et al.

[11] 4,340,270

[45] Jul. 20, 1982

[54] ELECTRICAL TERMINAL UNIT

[75] Inventors: Manfred Wilmes; Karl Marienfeld, both of Detmold, Fed. Rep. of Germany

[73] Assignee: C. A. Weidmuller KG, Detmold, Fed. Rep. of Germany

[21] Appl. No.: 109,726

[22] Filed: Jan. 4, 1980

[30] Foreign Application Priority Data

Jan. 24, 1979 [DE] Fed. Rep. of Germany ..... 2902536

[51] Int. Cl.[3] ..... H01R 11/20

[52] U.S. Cl. ..... 339/95 D; 339/198 GA

[58] Field of Search ..... 339/198 GA, 95 D, 97 R, 339/98, 99

[56] References Cited

U.S. PATENT DOCUMENTS

| | | | |
|---|---|---|---|
| 2,705,787 | 4/1955 | Benander | 339/95 D X |
| 3,718,888 | 2/1973 | Pasternak | 339/98 |
| 3,757,281 | 9/1973 | Woertz et al. | 339/95 D X |
| 4,157,208 | 6/1979 | Roberts et al. | 339/98 |
| 4,223,971 | 9/1980 | Dola et al. | 339/95 D |

FOREIGN PATENT DOCUMENTS

| | | | |
|---|---|---|---|
| 1430311 | 1/1966 | France | 339/97 R |

*Primary Examiner*—Eugene F. Desmond

[57] ABSTRACT

An electrical terminal unit, of the rail-mounted type, has terminals consisting of metal cntact parts with slots, and movable actuating members of insulating material provided with heads designed to receive and to entrain insulated conductors. The heads of the actuating members can be moved relative to the slotted contact parts so as to bring the inserted conductors into the slots, so that the slot edges cut the insulation and make contact with the conductor cores, and the connections can be broken by moving the actuating members away from the contact parts, thereby entraining the conductors and pulling these clear of the contact parts.

13 Claims, 6 Drawing Figures

ELECTRICAL TERMINAL UNIT

Figure 1:
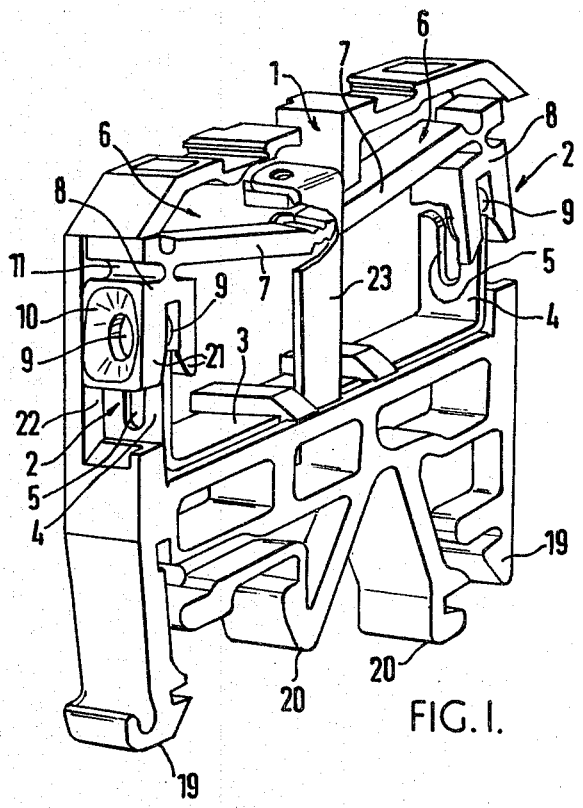

This invention concerns electrical terminal units capable of connection to insulated electrical conductors without stripping of the insulation. The invention is particularly applicable to terminal units of the type designed to be mounted in a row of similar terminal units to form a terminal assembly, usually on a common metal supporting rail.

Row-mountable terminal units can incorporate a wide variety of terminals, for example screw clamps, plug pins or sockets, and screwless terminals, which allow rapid connection and disconnection of conductors, but all these kinds of terminal require stripping of the conductors.

Electrical connectors are known in which insulated conductors are interconnected by metal members with slots which fit over the insulated conductors and which have cutting edges that penetrate the insulation and make electrical contact with the metal conductor cores; the slots are slightly narrower than the cores and therefore grip the latter to provide good contact. Such connectors are disclosed, for example, in German Patent Specifications Nos. 1,257,921, 2,010,436, 2,310,647 and 2,621,502. However, all these have the disadvantage that it is difficult or impossible to disconnect a conductor. The connectors are designed to be used only once, to make a permanent connection. They are therefore unsuitable for use in electrical terminal units of the row-mounted kind, in which easy disconnection is usually essential.

An object of the present invention is to provide a terminal unit which does not require stripping of conductors but from which conductors can nevertheless be easily disconnected.

According to one aspect of the present invention, there is provided an electrical terminal unit comprising an insulating housing and terminals therein for connection of electrical conductors, and in which at least one said terminal comprises a metal member with a conductor receptor shaped to receive an insulated conductor and provided with at least one cutting edge for penetrating the insulation of and making electrical contact with the conductive core of an insulated conductor, and an actuating member of electrically insulating material which member is movable relative to the metal member and has guiding means adapted to receive an electrical conductor and to entrain the latter when the actuating member is moved, whereby a conductor entrained by the actuating member will be moved into and out of engagement with the conductor receptor of the associated metal members.

According to another aspect of the invention, there is provided a row-mountable electrical terminal unit having terminals for incoming and outgoing insulated electrical conductors, and an insulating housing, at least one terminal being constructed as a cut-through connector with a metal member which is provided with cutting edges on its conductor receptor and with an actuating member which is disposed in the terminal housing so as to be movable relative to said metal part and consists of electrically insulating material and is provided with entrainment guides for the conductor.

Since the actuating member is made of electrically insulating material and is designed to entrain an inserted conductor, connection of the conductor is facilitated but, more importantly, the actuating member can be used to move the conductor away from the metal contact member, so that the conductor can easily be disconnected.

Preferably, the actuating member has a bifurcated head, the arms of which are respectively on opposite sides of the conductor receptor and have holes aligned with each other to receive and entrain the conductor. This arrangement provides reliable retention and guidance of the conductor during connection and disconnection, and prevents deformation of the conductor when it is brought into engagement with the metal contact member, because the conductor is positively located by the arms of the head of the actuating member, close to each side of the conductor receptor.

The actuating member can take numerous different forms, some of which will be described by way of example below.

In the accompanying drawings:

FIG. 1 is a perspective view of a terminal unit embodying the invention, and FIGS. 2 to 6 are schematic partial sectional views of further terminal units embodying the invention.

FIG. 1 shows a rail-mountable terminal unit with a housing 1 of electrically insulating material. Like known rail-mounted terminal units, the housing is generally slab-shaped, with two parallel major side faces, between which extend narrow faces. In use, the major side faces abut adjacent terminal units and only the narrow faces are accessible, being provided with openings for insertion of conductors and access for actuation of the terminals provided in the housing. For mounting on a rail of channel section with outwardly turned flanges, the housing has a pair of outer projections 19 which clip onto and can be unclipped from the rail flanges. The foot of the housing also has a pair of inner projections 20 which can be clipped onto and unclipped from the flanges of an alternative type of mounting rail, of channel section with inwardly turned flanges. Such rails are standardised.

The terminal unit shown in FIG. 1 has at opposite sides respective terminals 2 for conductors to be interconnected. A metal connecting strip 3 mounted in the housing has at each end an upstanding contact part 4 in which is a slot 5 forming a receptor for an electrical conductor. Each slot is open at the top, i.e., away from the rest of the metal member 3, and its internal edges form cutting edges. The shape and size of the slot is matched to the standardized conductor core thickness, so that if an insulated conductor is pressed into the slot 5, the edges of the latter will cut through the insulation of the conductor and the metal core of the conductor will come into intimate mechanical and electrical contact with the sides of the slot, which squeeze the core.

Each terminal is provided with an actuating member 6 of insulating material, mounted in the housing of the terminal unit. Each actuating member shown in FIG. 1 has a bifurcated head 8 at the free end of a lever 7 pivotably supported in the housing 1. The arms 21 of the bifurcated head are on opposite sides of the slotted part 4 and close to the latter, and have through holes 9 aligned with each other and with the slot 5. The arms 21 are close to the sides of the metal part 4, and the outer arm has a frustoconical or otherwise tapered inlet guide portion 10 leading to the hole 9.

To make a connection, with the parts in the positions shown in FIG. 1, an insulated conductor is inserted into the holes 9, and the actuating member 6 is then pivoted downwards, thereby entraining the conductor and forcing it into the associated slot 5. The edges of the slot cut through the insulation of the conductor and make firm electrical and mechanical contact with the conductor core. The head 8 has a recess 11 into which a screwdriver or other tool can be inserted for moving the actuating member 6. To release the conductor, the actuating member is raised, and the conductor is entrained by the holes 9 and thereby lifted out of the slot 5.

It is to be understood that the terminal unit can also be used for connection of stripped conductors.

At each side of the housing is a single opening 22 giving access to the tool recess 11 and holes 9. This opening, in conjunction with the housing of an adjacent terminal unit, guides the head 8 of the actuating member.

In the terminal unit shown in FIG. 1, the levers 7 of the two actuating members bear against one another and are guided in the housing. Alternatively, these levers could bear against the interior of the housing or on metal lugs of the interconnecting bar 3 or other abutments, for example in different positions from those shown in FIG. 1.

The metal bar 3 may have an upstanding lug 23, accessible through the top of the housing for testing or for making cross connections to other terminal units.

A wide variety of designs and positions for the actuating members and associated metal members is possible, enabling terminal units corresponding to substantially all known types of rail-mounted terminal unit to be provided with terminals for connection of unstripped conductors. Some possible arrangements will be described by way of example with references to FIGS. 2 to 6.

Figure 2:
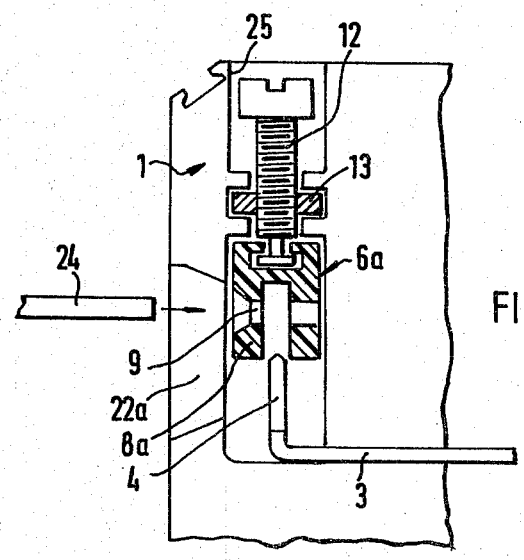

In the terminal unit shown in FIG. 2, the actuating member 6*a* is an insulating block forming a bifurcated head 8*a*, suspended from an actuating screw 12 threaded in a captive nut 13 in the housing. The screw and nut have threads of coarse pitch. The holes 9 of the actuating member are accessible through an opening 22*a* in the side of the housing, for insertion of a conductor 24. The head of the screw is accessible through an opening 25 in the top of the housing. By rotation of the screw, the head 8*a* with the conductor inserted in it can be moved down over the slotted metal part 4 to connect the conductor, or can be raised to disconnect the conductor.

Figure 3:
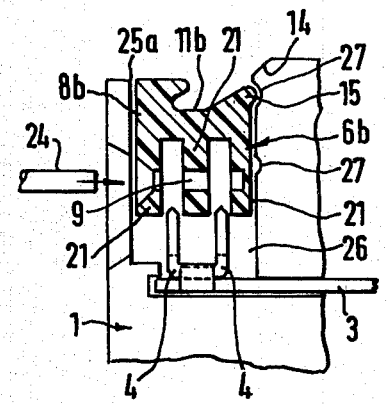

FIG. 3 shows an actuating member 6*b* which again is a block of insulating material which can slide bodily in a bore or slide way 26 in the insulating housing. The block is directly accessible through an opening 25*a* in the top of the housing, and has an oblique recess 11*b* in its top to receive a screwdriver or other tool. Its head 8*b* has three arms and correspondingly the metal contact bar 3 is provided with a contact member consisting of a U-shaped member forming two upstanding slotted metal parts 4, each aligned with a respective gap between the arms 21 of the actuating member. This provides two contact regions on the conductor core and thereby assures an especially reliable connection.

To make a connection, the conductor 24 is inserted into the holes 9 of the actuating member and the latter is then simply pushed downwards onto the slotted parts 4 by direct pressure on the actuating member. To break the connection, a screwdriver is inserted into the recess 11*b* and rests on an integrally formed oblique abutment surface 14 of the terminal housing, forming a fulcrum, so that the actuating member can be levered upwards to move the conductor clear of the slotted parts 4.

The insulating housing has internal detent recesses 27 to receive a bead 15 on the actuating member 6*b*, these recesses being placed so as to locate the actuating member in either the connected or fully disconnected position.

Figure 4:
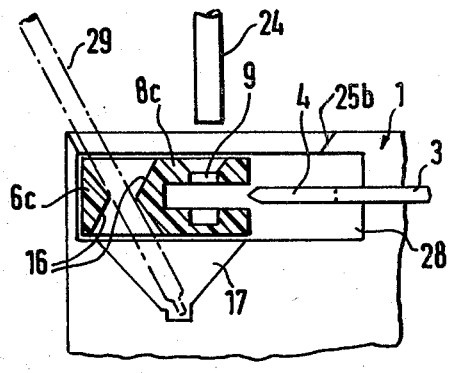

FIG. 4 shows a terminal unit with an actuating member 6*c* slidable horizontally in a recess or slideway 28 in the insulating housing 1. A connecting bar 3 has at its end a slotted contact part 4 projecting into the slideway 28. The conductor-receiving holes 9 of the actuating member face upwards, being accessible through an opening 25*b* in the top of the housing. The actuating member has a bifurcated head 8*c* which can be slid over the slotted part 4. Behind the holes 9, i.e., in the region of the actuating member furthest from the slotted metal contact part 4, the actuating member is penetrated by a double conical aperture 16 accessible through the opening 25*b*. Below the actuating member, the housing contains a recess 17 designed to receive the tip of a screw driver or other tool inserted through the opening 25*b* and apertures 16. Thus, an inserted tool can be pivoted about the bottom of the recess 17 and will thereby make the actuating member move horizontally towards or away from the metal contact part 4. A screwdriver shank 29 is shown in broken lines; by pivoting it from the illustrated position, the actuating member 6*c* and an inserted conductor 24 can be moved into engagement with the contact part 4. By opposite movement, the conductor can be moved clear of the contact part 4.

Figure 5:
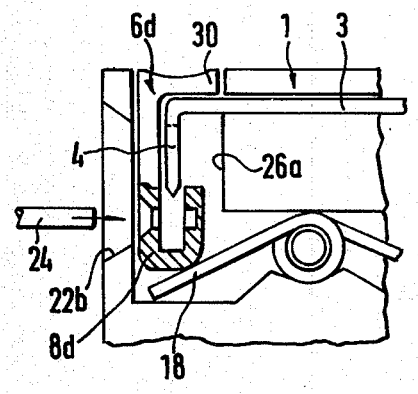

In the terminal unit shown in FIG. 5, the actuating member 6*d* can slide up and down in a slideway 26*a* in the insulating housing 1. The metal connecting member 3 has slotted end parts 4 which project downwards and are partly surrounded by the actuating member 6*d*. The lower end of the latter forms a U-shaped head 8*d* for receiving a conductor 24 inserted through an opening 22*b* in the side of the housing. The outer limb of the head is extended upwards by an inverted L-shaped portion 30 of which the horizontal upper limb forms an operating button. A wire spring 18 in the housing acts on the base of the U-shaped head, to urge the actuating member upwards, i.e., in the direction which will bring an inserted conductor 24 into contact with the contact part 4. To make a connection, the actuating member is pushed downwards, a conductor is inserted into its head, and it is then released, contact being established under the action of the spring 18. To release the conductor, the actuating member is pushed downwards again.

Figure 6:
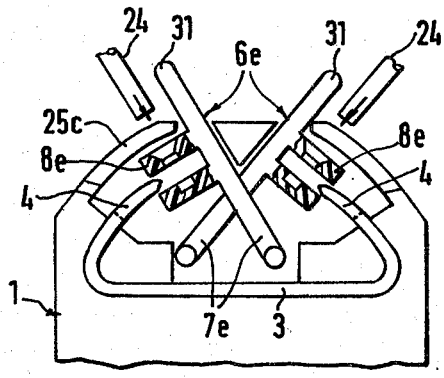

FIG. 6 shows a terminal unit with two actuating members 6*e* in the form of levers 7*e* pivotable in the insulating housing 1. The free end 31 of each lever projects from the housing, and each lever has at an intermediate position a bifurcated head 8*e* facing a slotted contact part 4 of a metal connecting member 3. The projecting ends 31 of the levers can be moved by hand to make and break connections between conductors 24 and the contact parts 4. The access openings 25*c* are oblique in this embodiment, but could alternatively be in the top or side surfaces of the housing.

It is to be understood that the various different features of design and construction shown in FIGS. 1 to 6 can be combined in various ways; for example, spring loading of the actuating member into the contact position, and/or detents for locating the actuating member, can be provided in the terminal units shown in FIGS. 1 and 3 to 6. Operation by means of a screw, as shown in FIG. 2, can be provided in any terminal unit where particularly high forces are needed or encountered or where positive location of the actuating member is essential. An extra bifurcation and corresponding metal contact part, as in FIG. 3, can be provided in the other terminal units if extra reliability is needed. All such variations and combinations are considered to be within the scope of the present invention.

We claim:

1. An electrical terminal unit comprising an insulating housing and terminals therein for connection of electrical conductors, and in which at least one said terminal comprises a metal member within said housing with a conductor receptor shaped to receive an insulated conductor and provided with at least one cutting edge for penetrating the insulation of and making electrical contact with the conductive core of an insulated conductor, and an actuating member of electrically insulating material which member is movable relative to said metal member and has guiding means within said housing adapted to receive an electrical conductor and to entrain the latter when said actuating member is moved, whereby a conductor entrained by said actuating member will be moved into and out of engagement with said conductor receptor of the associated metal members, and in which said actuating member is provided with a bifurcated head, the fork arms of which are situated respectively on opposite sides of said conductor receptor with said metal member and have therein insertion bores which are in alignment with each other and function as entrainment guides for said conductor.

2. A terminal unit according to claim 1 in which said actuating member is guided in a receptacle of said housing which receptacle is open at the top, and said actuating member has, at the open end of said receptacle, an oblique receptor for an actuating tool, a support surface for such tool being provided on said terminal housing.

3. A terminal unit according to claim 1 in which said actuating member is slidable in a recess in said housing, said recess having an internal wall, and behind said bifurcated head said actuating member is provided with a double-conical actuating aperture for the insertion of an actuating tool in different spatial positions, and a correspondingly shaped tool receptor is provided for said actuating tool in the internal wall of said recess, whereby said actuating member is movable by pivoting of the inserted tool.

4. A terminal unit according to claim 1, in which said actuating member is biased by a spring in one direction of movement, and is disposed in said terminal housing so as to be accessible from the exterior for movement in the opposite direction.

5. A terminal unit according to claim 1 in which the head of said actuating member is provided with three fork arms and said metal member is provided with two conductor receptors each between two said arms.

6. A terminal unit according to claim 1, in which said bifurcated head is provided with a tool receptor which is accessible through a conductor-access opening provided in said terminal housing to admit a conductor to said conductor receptor, said tool receptor being adapted for receiving a tool inserted through said opening for moving said actuating member.

7. An electrical terminal unit comprising an insulating housing and terminals therein for connection of electrical conductors, and in which at least one said terminal comprises a metal member within said housing with a conductor receptor shaped to receive an insulated conductor and provided with at least one cutting edge for penetrating the insulation of and making electrical contact with the conductive core of an insulated conductor, and an actuating member of electrically insulating material, which member is movable relative to said metal member and has guiding means within said housing adapted to receive an electrical conductor and to entrain the latter when said actuating member is moved, whereby a conductor entrained by said actuating member will be moved into and out of engagement with said conductor receptor of the associated metal members, said actuating member being a lever pivotably supported in the interior of said terminal unit, which lever has at its free end a bifurcated head the fork arms of which are situated respectively on opposite sides of said conductor receptor with said metal member and have therein insertion bores which are in alignment with each other and function as entrainment guides for said conductor.

8. A terminal unit according to claim 7, in which said lever projects outwardly beyond said terminal housing for manual operation.

9. An electrical terminal unit comprising an insulating housing and terminals therein for connection of electrical conductors, and in which at least one said terminal comprises a metal member within said housing with a conductor receptor shaped to receive an insulated conductor and provided with at least one cutting edge for penetrating the insulation of and making electrical contact with the conductive core of an insulated conductor, and an actuating member of electrically insulating material which member is movable relative to said metal member and has guiding means within said housing adapted to receive an electrical conductor and to entrain the latter when said actuating member is moved whereby a conductor entrained by said actuating member will be moved into and out of engagement with said conductor receptor of the associated metal members, and including an actuating screw and a nut inserted in said terminal housing, said screw being threaded in said nut and being disposed for moving said actuating member, said actuating member being provided with a bifurcated head the fork arms of which are situated respectively on opposite sides of said conductor receptor with said metal member and have therein insertion bores which are in alignment with each other and function as entrainment guides for said conductor.

10. An electrical terminal unit comprising an insulating housing and terminals therein for connection of electrical conductors, and in which at least one said terminal comprises a metal member within said housing with a conductor receptor shaped to receive an insulated conductor and provided with at least one cutting edge for penetrating the insulation of and making electrical contact with the conductive core of an insulated conductor, and an actuating member of electrically insulating material which member is movable relative to said metal member and has guiding means within said housing adapted to receive an electrical conductor and to entrain the latter when said actuating member is moved, whereby a conductor entrained by said actuating member will be moved into and out of engagement with said conductor receptor of the associated metal members, a hairpin spring being disposed in said terminal housing, said actuating member being provided with a U-shaped portion comprising a bifurcated head the fork arms of which are situated respectively on opposite sides of said conductor receptor with said metal member and have therein insertion bores which are in alignment with each other and function as entrainment guides for said conductor, the underside of said U-shaped portion being biased by said hairpin spring, and one limb of said U-shaped portion being extended by an L-shaped portion which extends around the portion of said metal member which incorporates said conductor receptor, said L-shaped portion being accessible from the outside of said housing.

11. A terminal unit according to any one of claims 1 to 10, in which a convergent lead-in surface, extending to said insertion bore, is provided on the outer side of the outwardly disposed fork arm of said bifurcated head for guiding a conductor into said aligned bores.

12. A terminal unit according to any one of claims 1 to 10, in which said actuating member is provided with a latching projection for which the terminal housing is provided with receptors, for locating said actuating element in positions in which a conductor respectively is engaged with and not engaged with said metal member.

13. An electrical terminal unit comprising an insulating housing and terminals therein for connection of electrical conductors, and in which at least one said terminal comprises a metal member within said housing with a conductor receptor shaped to receive an insulated conductor and provided with at least one cutting edge for penetrating the insulation of and making electrical contact with the conductive core of an insulated conductor, and an actuating member of electrically insulating material, which member is movable relative to said metal member and has guiding means within said housing adapted to receive an electrical conductor and to entrain the latter when said actuating member is moved, whereby a conductor entrained by said actuating member will be moved into and out of engagement with said conductor receptor of the associated metal members, said actuating member being a lever pivotably supported in the interior of said terminal unit which lever has at its free end a head situated adjacent to said conductor receptor with the metal member which head has therein at least one insertion bore which is in alignment with said conductor receptor and functions as an entrainment guide for said conductor.

* * * * *